US006585351B2

(12) United States Patent
Nakagawa et al.

(10) Patent No.: US 6,585,351 B2
(45) Date of Patent: Jul. 1, 2003

(54) ANGULAR WIPING SYSTEM FOR INKJET PRINTHEADS

(75) Inventors: Takaaki Nakagawa, Camas, WA (US); Richard J. Gerth, Ann Arbor, MI (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 29 days.

(21) Appl. No.: 10/016,791

(22) Filed: Oct. 30, 2001

(65) Prior Publication Data

US 2003/0081056 A1 May 1, 2003

(51) Int. Cl.[7] ..... B41J 2/165
(52) U.S. Cl. ..... 347/33; 347/32
(58) Field of Search ..... 347/33, 38, 32, 347/22

(56) References Cited

U.S. PATENT DOCUMENTS 5,103,244 A 4/1992 Gast et al. ..... 347/33
5,614,930 A 3/1997 Osborne et al. ..... 347/33
5,896,145 A 4/1999 Osborne et al. ..... 347/33
5,980,018 A 11/1999 Taylor et al. ..... 347/31
6,132,026 A 10/2000 Taylor et al. ..... 347/32
6,340,218 B1 * 1/2002 Gaylor ..... 347/33
6,352,334 B2 * 3/2002 Fukushima et al. ..... 347/33

* cited by examiner

*Primary Examiner*—Thinh Nguyen

(57) ABSTRACT

An angular wiping system is provided for removing ink residue from an inkjet printhead installed in an inkjet printing mechanism. By canting a wiper blade in opposite directions as the blade moves through a bi-directional wiping stroke, a nozzle portion of the ink-ejecting orifice plate is wiped on both passes of the blade. A pair of non-ink-ejecting side cheeks of the orifice plate laying on opposite sides of the nozzle portion are each wiped once during the bi-directional wiping stroke, with one cheek being wiped while the blade travels in a first direction, and the other cheek being wiped when the blade travels in a direction opposite to the first direction. An inkjet printing mechanism having the angular wiping system and method of wiping using this system are also provided.

24 Claims, 3 Drawing Sheets

ANGULAR WIPING SYSTEM FOR INKJET PRINTHEADS

The present invention relates generally to inkjet printing mechanisms, and more particularly to an angular wiping system for removing ink residue from an inkjet printhead in an inkjet printing mechanism.

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper.

During wiping, it is important not only to wipe the orifice plate in the area of the linear nozzle arrays which eject ink, but also to wipe along the cheek regions of the printhead adjacent the orifice plate as described in U.S. Pat. Nos. 5,980,018 and 6,132,026, both assigned to the present assignee, Hewlett-Packard Company. These patents discuss a system which has nozzle wiper blades dedicated to wiping the orifice plate along the ink ejecting nozzles, and an auxiliary pair of cheek wiper blades located to each side of the nozzle wiper blades. The cheek wiper blades remove debris along the cheek regions of the printhead adjacent the nozzles, and are referred to therein as "mud flaps." The term "mud flap" was used because these auxiliary cheek wipers if inverted resemble the rubber mud flaps used on pickups, semi-tractor trailers and the like to prevent mud from being flung from a vehicle's rear wheels onto a following vehicle.

Use of the auxiliary mud flap wiper blades removed ink residue clinging to the cheek regions of the printhead. If otherwise left untouched, this cheek ink residue often attracted fibers, such as clothing lint or hairs. Such fibers clinging to the printhead often extended down to touch the media in the printzone, and when the trailing fibers were pulled by the carriage through freshly printed ink, they caused the ink to smear leaving horizontal streaks across the printed image, resulting in a print defect known in the industry as "fiber tracks."

As additional components are introduced into inkjet printers for the home, office and business environment, such as various optical sensors like those described in U.S. Pat. No. 6,036,298, currently assigned to the present assignee, the Hewlett-Packard Company. In the home and office environment, the amount of work space consumed by a printer, known as the printer's "footprint," is desired to be at a minimum. Use of these additional sensors often increases the overall printer width, increasing the printer's footprint, requiring a trade-off between providing a consumer with additional features, while still providing a compact printing unit. Use of the auxiliary mud flaps to clean the cheek regions of a printhead to eliminate fiber tracking, in addition to the use of various sensors located in the service station region, in some cases increase the overall printer width up to one inch (2.54 cm). Thus, it would be desirable to find a way to control fiber tracking without increasing the footprint of the printing unit.

DRAWING FIGURERS

DETAILED DESCRIPTION

Figure 1:
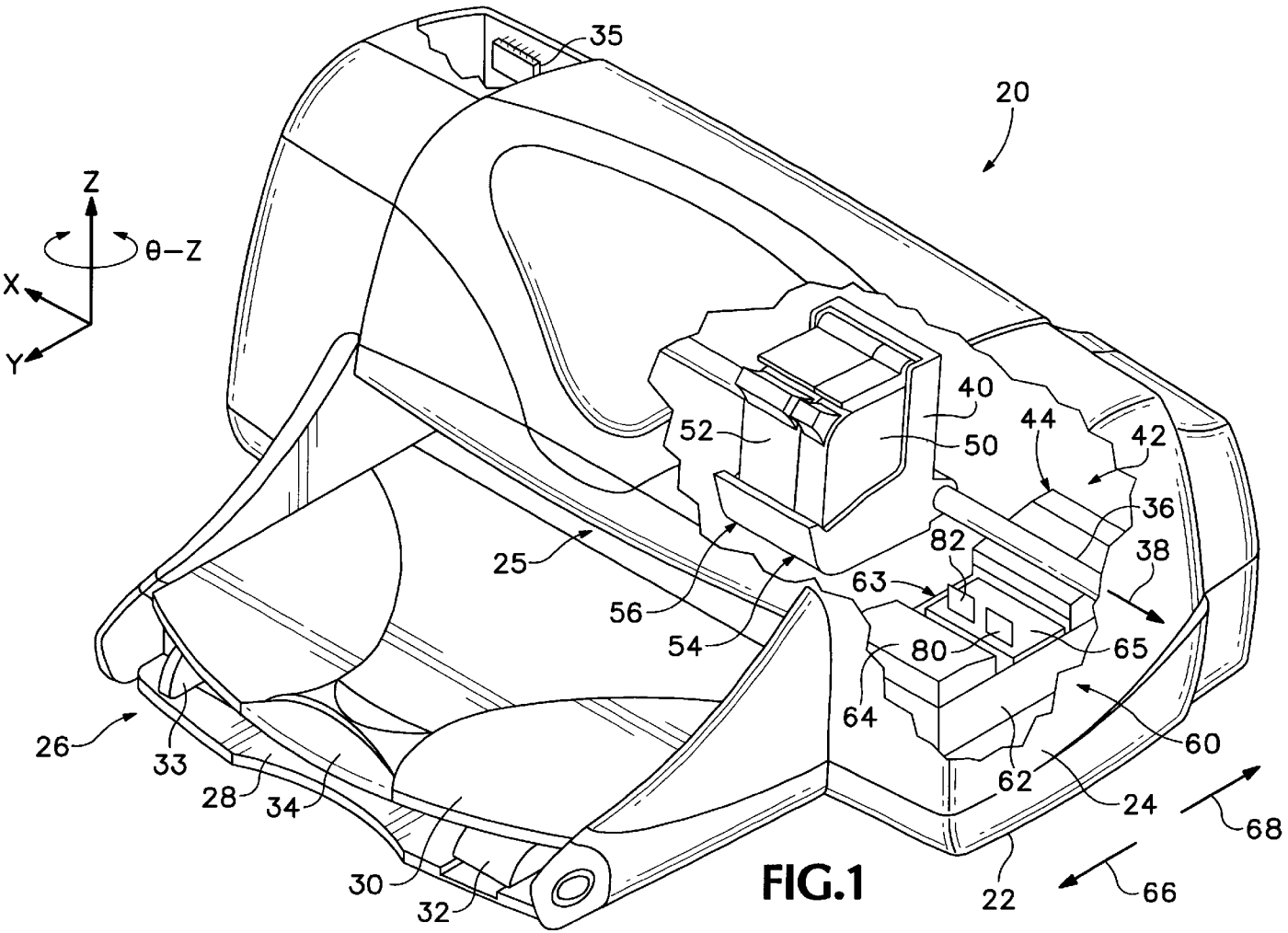
FIG. 1 is a perspective view of one form of an inkjet printing mechanism, here shown as an inkjet printer, including a service station having one form of an angular wiping system of the present invention.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by a print media handling system 26.

The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on output tray portion 30. The media handling system 26 may include a series of adjustment mechanisms for accommodating different sizes of print media, including letter, legal, A-4, envelopes, etc., such as a sliding length and width adjustment levers 32 and 33 for the input tray, and a sliding length adjustment lever 34 for the output tray.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer controller 35 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 36 is mounted to the chassis 22 to define a scanning axis 38. The guide rod 36 slideably supports a reciprocating inkjet carriage 40, which travels back and forth across the printzone 25 and into a servicing region 42. Housed within the servicing region 42 is a service station 44, which will be discussed in greater detail below with respect to the present invention. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The nozzles are most often arranged in two linear arrays. The term "linear" as used herein may be interpreted as "nearly linear" or substantially linear, and may include nozzle arrangements slightly offset from one another, for example, in a zigzag arrangement. The illustrated printheads 54, 56 are thermal inkjet printheads, although other types of printheads may be used, such as piezoelectric printheads. These printheads 54, 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50, 52 to the printheads 54, 56.

The service station 44 includes one form of an angular wiping system 60, constructed in accordance with the present invention. The service station 44 includes a service station base 62, which has a hollow interior that forms a spittoon portion 63 of the service station for receiving ink droplets purged or spit from the printheads 54, 56. The service station frame also includes a bonnet portion 64 which overlays the service station frame base 62. Sandwiched between the frame base 62 and bonnet 64 is a wiper sled or pallet 65 which moves in a forward direction 66 and a rearward direction 68 when powered by a gear assembly or transmission 70, shown in FIGS. 2 and 3. The motor 70 may be coupled through a conventional gear assembly (not shown) to drive a pinion gear 72 which engages a rack gear 74 located along an under surface of the wiper pallet 65. For instance, to move the pallet 65 in the forward direction 66, the pinion gear 72 rotates in a clockwise direction 76 as shown in FIG. 2, whereas pallet movement in the rearward direction 68 is accomplished by counter-clockwise rotation of the pinion 72, as indicated by arrow 78.

Referring back to FIG. 1, the pallet 65 is shown as carrying two upright wiper blades 80, 82, for wiping the black and color printheads 54, 56 respectively. The wiper blades 80 and 82 may be constructed of a resilient, non-abrasive, elastomeric material, such as nitrile rubber, ethylene polypropylene diene monomer (EPDM), or other comparable materials known in the art. Note that while only two printheads 54, 56 and two wiper 80, 82 are shown, the principles described herein may be applied to a single printhead system having a single wiper, or to systems having four, six or more printheads, preferably with a wiper blade, such as wiper 80, dedicated to each printhead. Furthermore, in the case of a page wide array printer, having a single printhead extending across the entire printzone 25, one or more wiper blades may also be used in the manner described herein for printhead cleaning. Furthermore, while single wiper blades 80, 82 are shown for wiping each of the printheads 54, 56, it is apparent that a dual wiper blade system may also be used, for instance as shown in U.S. Pat. No. 5,614,930, currently assigned to the present assignee, the Hewlett-Packard Company.

Figure 2:
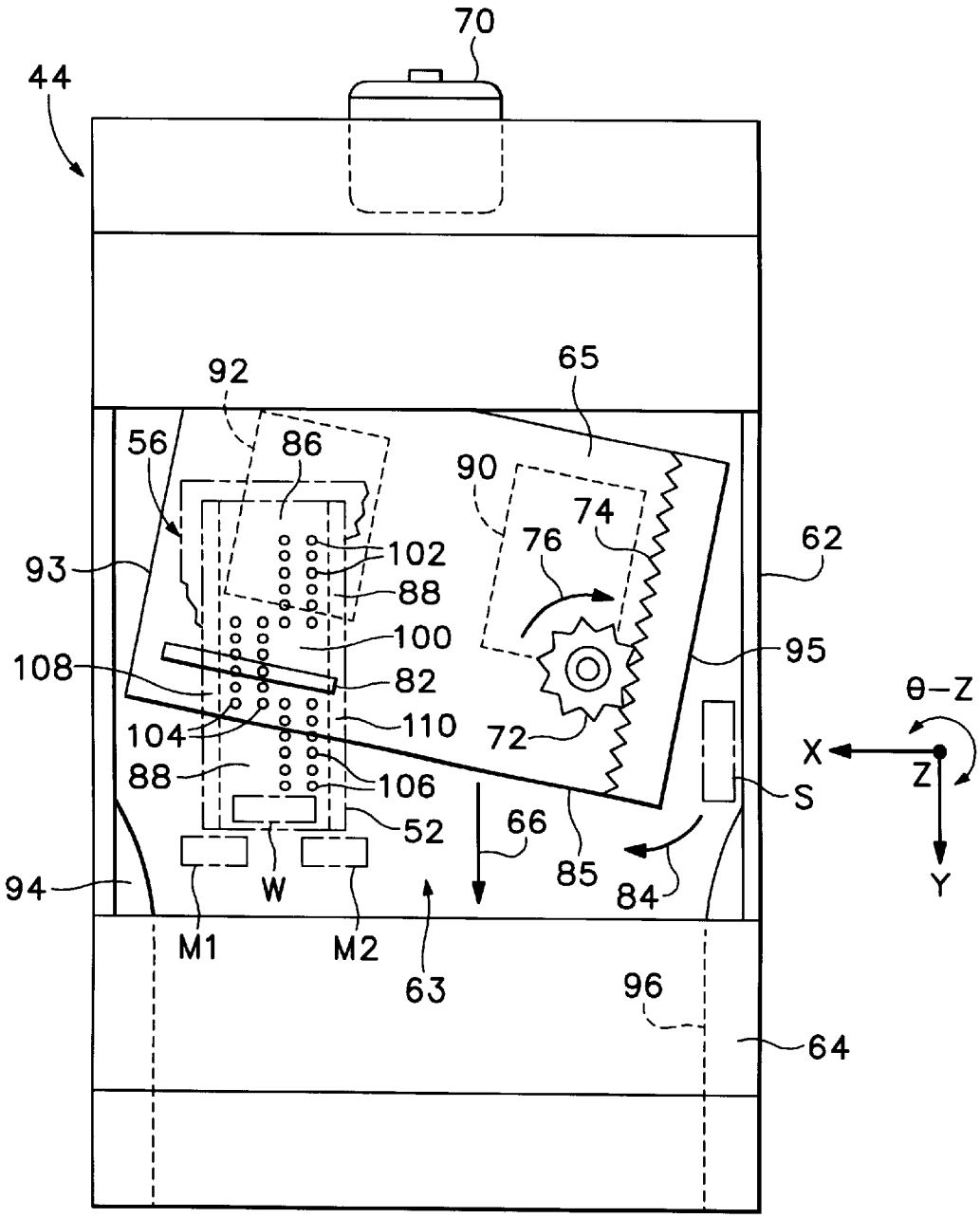
FIG. 2 is a partially schematic, fragmented, top plan view of the service station of FIG. 1 shown during a first printhead wiping stage.
Figure 3:
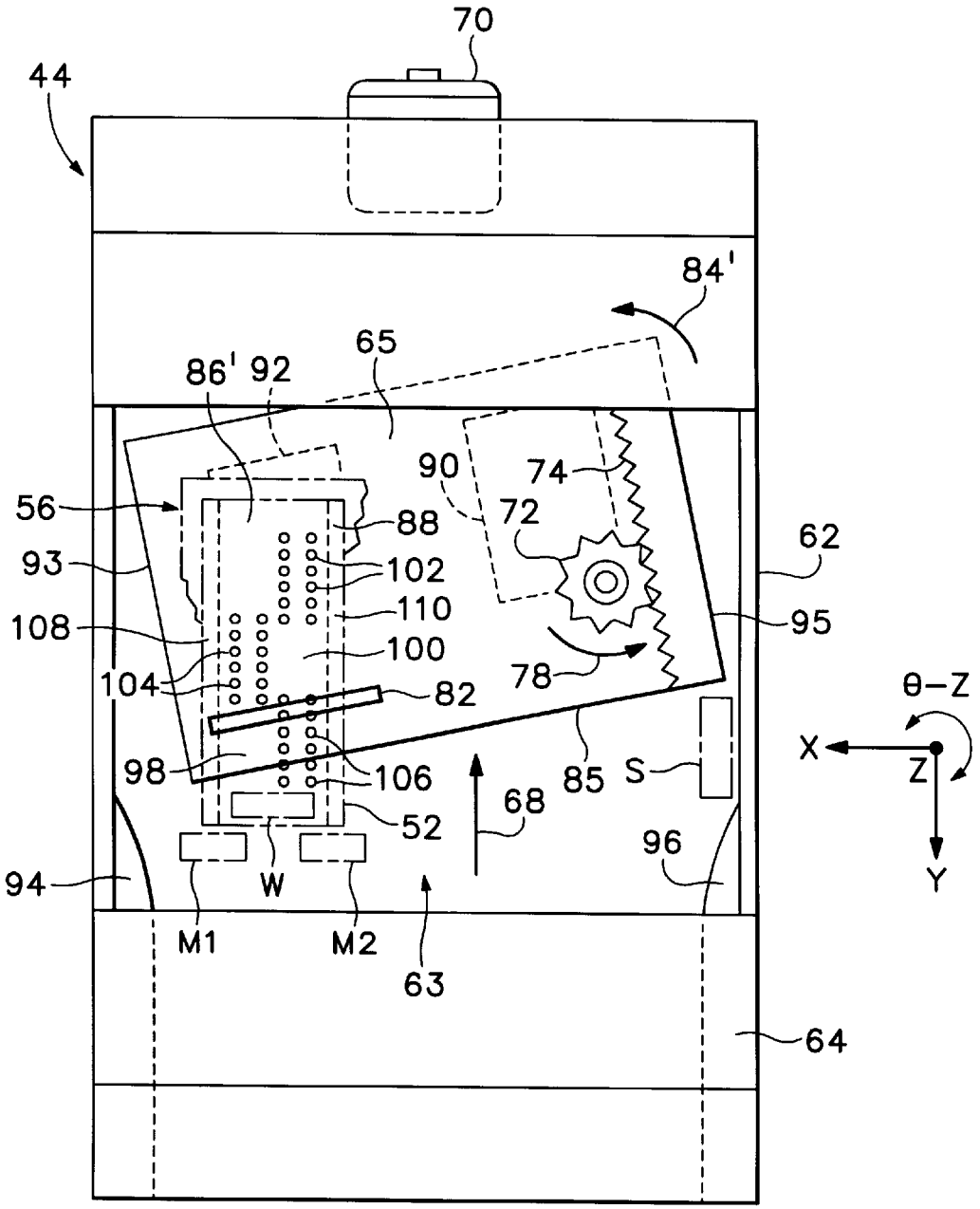
FIG. 3 is a partially schematic, fragmented, top plan view of the service station of FIG. 1, shown during a second printhead wiping stage.

FIGS. 2 and 3 show the first and second stages, respectively, of an angular printhead wiping routine employed by system 60. In the illustrated embodiment, there is a relatively loose fit between the pallet 65 and the interior sidewalls of the service station base 62, along which the pallet 65 rides. This relatively loose fit, allows the pallet 65 to rotate in a clockwise direction, as indicated by curved arrow 84 when driven in the forward direction 66 by motor 70. By aligning the wiper blade 82 to be substantially parallel with the front edge 85 of the rectangularly shaped pallet 65, this tortioning or twisting of the pallet 65 then presents the wiper blade 82 at an angle as it wipes across the printhead 56, rather than having a perpendicular wiping orientation as previously known to be used in the industry. Indeed, as shown for the XYZ coordinate axis system in the drawings, this clockwise twisting 84 of pallet 65 results in what is known as a Theta-Z (θ-Z) twist to the sled 65. As shown in FIG. 2, this θ-Z twist to the pallet 65 results in wiper blade 82 leaving behind it a first wiped printhead area 86, and a non-wiped area 88. As an aside, note that the pallet 65 may also carry other printhead servicing components such as primers, solvent applicators, or printhead caps, such as caps 90 and 92 shown in dashed lines, for sealing the black and color printheads 54 and 56, respectively. Note that the black wiper 80 along with printhead 54 have both been omitted from the views of FIGS. 2 and 3 for clarity to better illustrate the operation of the angular wiping system 60.

Further forward travel 66 of the pallet 65 beyond the position shown in FIG. 2 allows an in board sidewall 93 of the pallet to eventually come into engagement with an in board aligning member 94, and an outboard sidewall 95 of the pallet to come into contact with an optional outboard aligning wall 96. As used herein, the term "in board" refers to components facing toward the printzone 25, that is, in the positive X-axis direction, whereas the term "outboard" refers to components facing toward the servicing region 42 or in the negative X-axis direction. Contact of the pallet sidewalls 93, 95 with the alignment wall 94, 96 forces the pallet 65 to regain a parallel, centered orientation with respect to the service station base 62. The alignment walls 94, 96 may extend inwardly from either the service station base 62 or the bonnet 64. Alternatively, the bonnet 64 or base 62 may have a guide track (not shown) which engages a feature such as a post which extends from either the upper or lower surface of the pallet 65, or other alignment mechanisms may also be provided. Bring the pallet into a rectangular alignment with the base 62 and bonnet 64 allows the caps 90, 92 to be located directly under the printheads 54, 56 for sealing, for instance in the manner described in U.S. Pat. Nos. 5,980,018 and 6,132,026, mentioned in the Introduction section above.

With or without moving to the capping position where the pallet 65 is aligned between the alignment walls 94, 96, the pallet 65 may begin the second or return stage of the wiping stroke, as shown in FIG. 3 where the pallet is moving in the rearward direction 68. In FIG. 3, we see that the torque provided by the pinion gear 72 has rotated the pallet 65 in a counter-clockwise direction, as indicated by the curved arrow 84'. Thus, on the return wiping stroke of FIG. 3, the wiper blade 82 covers a second wiped area 98. When summing the areas covered by the first wiped area 86 and the second wiped area 98, we see that they overlap in a nozzle area 100 where arrays of cyan, yellow and magenta nozzles 102, 104, 106 of printhead 56 reside. Furthermore, cheek regions 108 and 110 have each been wiped once during the respective first and second wiping strokes of FIGS. 2 and 3.

Thus, using the angular wiping system 60, a single wiper blade 80, 82 wipes not only the printhead nozzle area 100, but also the cheek regions 108, 110 using a bidirectional wiping stroke. In this manner, additional width is not required for the service station 42 to wipe not only the nozzle area 100, but also to wipe the cheek regions 108, 110 of the printheads 54, 56. Thus, the service station 44 does not increase in width while still adequately cleaning ink residue from not only the nozzle area 100, but also debris clinging to the cheek regions 108, 110, such as fibers which may otherwise trail down into the printzone 25, contacting the previously printed ink and create undesirable fiber tracks, described in the Introduction section above. By way of contrast, in long/short dashed lines in FIG. 2, the width of one earlier nozzle wiper W is shown, along with the width of auxiliary mud flaps M1 and M2 located to each side of the main wiper W. Thus, the pallet 65 in the earlier wiping schemes, such as those disclosed in U.S. Pat. Nos. 5,980,018 and 6,132,026 (mentioned above) increased the width of the service station 44, that is the width in the X-axis direction. A narrower service station pallet 65 allows more room to accommodate other printer components, such as by allowing a storage region for a carriage mounted optical sensor S, shown in long/short dashed lines in FIG. 3, and as discussed in the Introduction section above.

Thus, the angular printhead wiping system 60 wipes the orifice plate nozzles region 100, and eliminates fiber tracking by wiping the cheek regions 108, 110 to each side of the nozzles to avoid accumulating sticky ink residue which then attracts annoying lint, dust and fibers, such as fabric fibers, hairs, etc. In the earlier wiping systems briefly mentioned in the Introduction section above, one major difficulty in assuring that a wiper covers the entire pen surface is controlling the wipers in the X-axis direction so the pens wipe only the printhead surface, without over wiping beyond the printhead. To make maximum use of the wiper width versus the area wiped, the edges of the wiper are controlled relative to the in board and outboard edges of the pen 50, 52 for maximum wiping efficiency. As mentioned in the Introduction section, one competing design criteria is to have the printer occupy as small of a footprint on a work surface as possible, to provide a compact printing unit for the consumer. Thus, the angular wiping system 60 reduces variation in the position of the wiper edges relative to the pen edges, thereby maximizing wiper engagement efficiency, while providing a more compact printing unit 20.

Other earlier linear nozzle array designs have been wiped either across nozzle arrays and back again along the X-axis, or they have wiped "orthogonally" along the length of the linear nozzle array in the Y-axis direction, as described in U.S. Pat. No. 5,614,930. In the past, wiping system designers have focused their efforts on improved datuming schemes to align the printhead and wiper, biasing the pallet and/or sleds with various springs, direct dimensioning, etc. The angular wiping system 60 rejects these earlier preconceived notions that a printhead 54, 56 must be wiped completely going in both the forward direction 66 and the rearward direction 68. Instead, the angular wiping system 60 wipes one side of a printhead moving in a forward direction (FIG. 2), and wipes the opposing side of the printhead moving in the opposing direction (FIG. 3), with an overlap being provided between the two wiping strokes to preferably cover the nozzle area 100. In this manner, the nozzle area 100 receives two wiping strokes, while the cheek regions which accumulate less debris and ink residue receive a unilateral or single wipe. Thus, the angular wiping system 60 economizes on wiper width versus the amount of printhead area covered by the wiper during a bi-directional wiping stroke. Indeed, for some implementations, it may be sufficient, for instance using the black printhead 54 having two linear nozzle arrays running the length of the printhead, to wipe one nozzle array and the cheek region adjacent thereto during the first wiping stroke (FIG. 2), and then to wipe the second linear nozzle array and the cheek region adjacent thereto during the second portion of the wiping stroke (FIG. 3). In this manner, each nozzle linear array receives a single wiper application; although providing two wipes for the nozzle arrays as shown in FIGS. 2 and 3 is believed to be preferable.

In conclusion, use of the angular wiping system 60 allows a narrower wiper to cover more of the printhead surface area, thereby minimizing the overall printer width to provide a smaller footprint for the printing unit 20, while still providing a superior wiping system, which not only wipes the nozzle area 100, but also the adjacent cheek regions 108, 110. This is possible using the θ-Z canting or cocking of the pallet 65 with respect to the service station base 62, providing a positive θ-Z (clockwise) rotation when moving in the forward direction 66, and a negative θ-Z (counter-clockwise) rotation when moving in the rearward direction 68. By allowing some "slop" between the pallet sidewalls 63, 65 and the service station base 62 and/or bonnet 64, this rotation, canting or cocking of the pallet 65 and the resulting cocking of the wipers 80, 82, allows for an angular wiping scheme as the blades 80 and 82 encounter the printheads 56, 54.

A variety of different mechanisms may be used to accomplish this rotation of the pallet 65, such as using various ramps, solenoids, springs or other biasing devices, as would be understood by those skilled in the art as being within expected variations of the claims appended below, while still falling within their scope. Indeed, in some implementations it may be preferable to move the pallet 65 along the positive and negative X-axis directions to accomplish the same wiping pattern, although the illustrated rotation or canting of the pallet 65, and wipers 80, 82 is preferred to minimize upon parts and operational variations. Furthermore, using the angular wiping system 60 as described herein provides a more robust wiping system for the printer 20, accommodating both manufacturing variations as well as environmental factor variations, such as changes in temperature, and plastic or elastomeric creep which parts often encounter over time. Thus, the angular wiping system 60 not only increases product quality, but also allows the service station 44 to be produced with fewer components in a more compact configuration, leading to a smaller footprint for the printing unit 20 as well as allowing for a more economical unit to be provided for consumers.

We claim:

1. An angular wiping system for removing ink residue from a printhead in an inkjet printing mechanism, wherein the printhead has ink-ejecting nozzles arranged in a linear array, comprising:

a support movable through a wiping stroke which is substantially parallel to the linear nozzle array; and a wiper having a width dimension, with the wiper being supported by said support so the width dimension is at a non-perpendicular angle with respect to the linear array during the wiping stroke.

2. An angular wiping system according to claim 1 wherein:

the support has a leading edge;

the width dimension of the wiper is substantially parallel to the leading edge; and said leading edge is advanced at the non-perpendicular angle with respect to the linear array during the wiping stroke.

3. An angular wiping system according to claim 2 further including a drive mechanism coupled to propel the support through the wiping stroke, wherein said drive mechanism rotates the support into said non-perpendicular angle while advancing the support through the wiping stroke.

4. An angular wiping system according to claim 3 wherein:

said drive mechanism propels the support through the wiping stroke in a first direction then in a second direction opposite said first direction;

said drive mechanism rotates the support into said non-perpendicular angle while advancing the support in the first direction; and said drive mechanism rotates the support into another non-perpendicular angle with respect to the linear array while advancing the support in the second direction.

5. An angular wiping system according to claim 4 wherein said non-perpendicular angle is on a first side of said linear array, and said another non-perpendicular angle is on a second side of said linear array opposite said first side.

6. An angular wiping system according to claim 4 wherein said non-perpendicular angle is substantially equal to said another non-perpendicular angle with respect to said linear array.

7. An angular wiping system according to claim 4 wherein:

said printhead has an orifice plate which defines said nozzles and has a first side region to one side of said linear array and a second side region to a side of said linear array opposite said one side;

when said drive mechanism propels the support in the first direction, the wiper wipes ink residue from the nozzle array and said first region; and when said drive mechanism propels the support in the second direction, the wiper wipes ink residue from the nozzle array and said second region.

8. An angular wiping system according to claim 4 wherein said non-perpendicular angle is substantially equal to said another non-perpendicular angle with respect to said linear array and comprises an acute angle of 65–85 degrees.

9. An angular wiping system according to claim 1 wherein said non-perpendicular angle comprises an acute angle of 65–85 degrees.

10. A method of cleaning ink residue from a printhead in an inkjet printing mechanism where the printhead has ink-ejecting nozzles arranged in a linear array, comprising:

moving a wiper through a wiping stroke which is substantially parallel to the linear nozzle array; and during said moving, wiping the printhead with a wiper having a width dimension which contacts the printhead at a non-perpendicular angle with respect to the linear array during said moving.

11. A method according to claim 10 further including supporting the wiper on a movable support, and advancing said support at the non-perpendicular angle with respect to the linear array during the wiping stroke.

12. A method according to claim 11 further including driving the support through the wiping stroke, and rotating the support into said non-perpendicular angle during said driving.

13. A method according to claim 10 wherein moving the wiper through the wiping stroke comprises cleaning the printhead in a bi-directional wiping stroke comprising:

moving the wiper in a first direction; and moving the wiper in a second direction opposite said first direction.

14. A method according to claim 13 wherein:

said printhead has an orifice plate which defines said nozzles and has a first side region to one side of said linear array and a second side region to a side of said linear array opposite said one side;

when said drive mechanism propels the support in the first direction, the wiper wipes ink residue from the nozzle array and said first region; and when said drive mechanism propels the support in the second direction, the wiper wipes ink residue from the nozzle array and said second region.

15. A method according to claim 13 wherein said non-perpendicular angle is on a first side of said linear array, and said moving the wiper in the second direction comprises wiping the printhead at another non-perpendicular angle on a second side of said linear array opposite said first side.

16. A method according to claim 15 wherein said non-perpendicular angle is substantially equal to said another non-perpendicular angle with respect to said linear array.

17. An inkjet printing mechanism, comprising:

a printhead having ink-ejecting nozzles arranged in a linear array;

a support movable through a wiping stroke which is substantially parallel to the linear nozzle array; and a wiper having a width dimension, with the wiper being supported by said support so the width dimension is at a non-perpendicular angle with respect to the linear array during the wiping stroke.

18. An inkjet printing mechanism according to claim 17 wherein:

the support has a leading edge;

the width dimension of the wiper is substantially parallel to the leading edge; and said leading edge is advanced at the non-perpendicular angle with respect to the linear array during the wiping stroke.

19. An inkjet printing mechanism according to claim 18 further including a drive mechanism coupled to propel the support through the wiping stroke, wherein said drive mechanism rotates the support into said non-perpendicular angle while advancing the support through the wiping stroke.

20. An inkjet printing mechanism according to claim 19 wherein:

said drive mechanism propels the support through the wiping stroke in a first direction then in a second direction opposite said first direction;

said drive mechanism rotates the support into said non-perpendicular angle while advancing the support in the first direction; and said drive mechanism rotates the support into another non-perpendicular angle with respect to the linear array while advancing the support in the second direction.

21. An inkjet printing mechanism according to claim 20 wherein said non-perpendicular angle is on a first side of said linear array, and said another non-perpendicular angle is on a second side of said linear array opposite said first side.

22. An inkjet printing mechanism according to claim 20 wherein said non-perpendicular angle is substantially equal to said another non-perpendicular angle with respect to said linear array.

23. An angular wiping system according to claim 20 wherein:

said printhead has an orifice plate which defines said nozzles and has a first side region to one side of said linear array and a second side region to a side of said linear array opposite said one side;

when said drive mechanism propels the support in the first direction, the wiper wipes ink residue from the nozzle array and said first region; and when said drive mechanism propels the support in the second direction, the wiper wipes ink residue from the nozzle array and said second region.

24. A method of cleaning ink residue from a printhead in an inkjet printing mechanism where the printhead has ink-ejecting nozzles arranged in a linear array, comprising:

moving a wiper through a wiping stroke which is substantially parallel to the linear nozzle array; and during said moving, wiping the printhead with a wiper having a width dimension; and tilting said width dimension to a non-perpendicular angle with respect to the linear array during said moving.

* * * * *